US008167289B2

(12) United States Patent
Schar

(10) Patent No.: US 8,167,289 B2
(45) Date of Patent: May 1, 2012

(54) CLAMPING ELEMENT FOR WORKPIECES, IN PARTICULAR A VICE

(75) Inventor: Andreas Schar, Schweiz (CH)

(73) Assignee: Promero SA, Luxembourg (LU)

( * ) Notice: Subject to any disclaimer, the term of this patent is extended or adjusted under 35 U.S.C. 154(b) by 1079 days.

(21) Appl. No.: 11/718,062

(22) PCT Filed: Nov. 23, 2005

(86) PCT No.: PCT/EP2005/012540

§ 371 (c)(1),
(2), (4) Date: Apr. 26, 2007

(87) PCT Pub. No.: WO2006/056422

PCT Pub. Date: Jun. 1, 2006

(65) Prior Publication Data

US 2009/0134562 A1 May 28, 2009

(51) Int. Cl.
*B25B 1/24* (2006.01)

(52) U.S. Cl. ..... 269/25; 269/257

(58) Field of Classification Search . 269/25; *B25B 1/24*
See application file for complete search history.

(56) References Cited

FOREIGN PATENT DOCUMENTS

| | | | |
|---|---|---|---|
| DE | 32 27 964 A1 | | 2/1984 |
| FR | 2 559 085 A | | 8/1995 |
| GB | 1 181 398 A | | 2/1970 |
| JP | 18-001750 | | 2/1940 |
| JP | 58028444 A | * | 2/1983 |
| JP | 2548545 | | 3/1988 |
| JP | 2576607 | | 7/1993 |
| JP | 5056392 U | * | 7/1993 |
| JP | 2000-218553 | | 8/2000 |

OTHER PUBLICATIONS

Japanese Office Action in corresponding Japanese Application 2007-541835, mailed Nov. 24, 2010, pp. 1-6.

* cited by examiner

*Primary Examiner* — Lee D Wilson
*Assistant Examiner* — Jamal Daniel
(74) *Attorney, Agent, or Firm* — Pauly, Devries, Smith & Deffner, L.L.C.

(57) ABSTRACT

This invention relates to a clamping element for workpieces, in particular a vice (10, 33, 40), comprising a first clamping jaw (12, 34, 41) and a second clamping jaw (13, 35, 42), which are mounted on a carriage bed (11). To avoid bending moments as a result of tensile forces acting on the carriage bed (11), the clamping element of the invention is characterized in that the resultants of the forces introduced by the clamping jaws (12, 13, 34, 35, 41, 42) into the carriage bed (11) as a result of the clamping forces acting on the clamping jaws (12, 13, 34, 35, 41, 42) are located in the plane of the neutral fiber (32) of the carriage bed (11). Preferably, the clamping jaws (12, 13, 41, 42) constitute two-armed levers, a clamping surface (21, 24) being associated to the one lever arm and a push rod (27, 46) engaging the other lever arm.

10 Claims, 2 Drawing Sheets

CLAMPING ELEMENT FOR WORKPIECES, IN PARTICULAR A VICE

Figures 1, 2, 3, 4, 5:
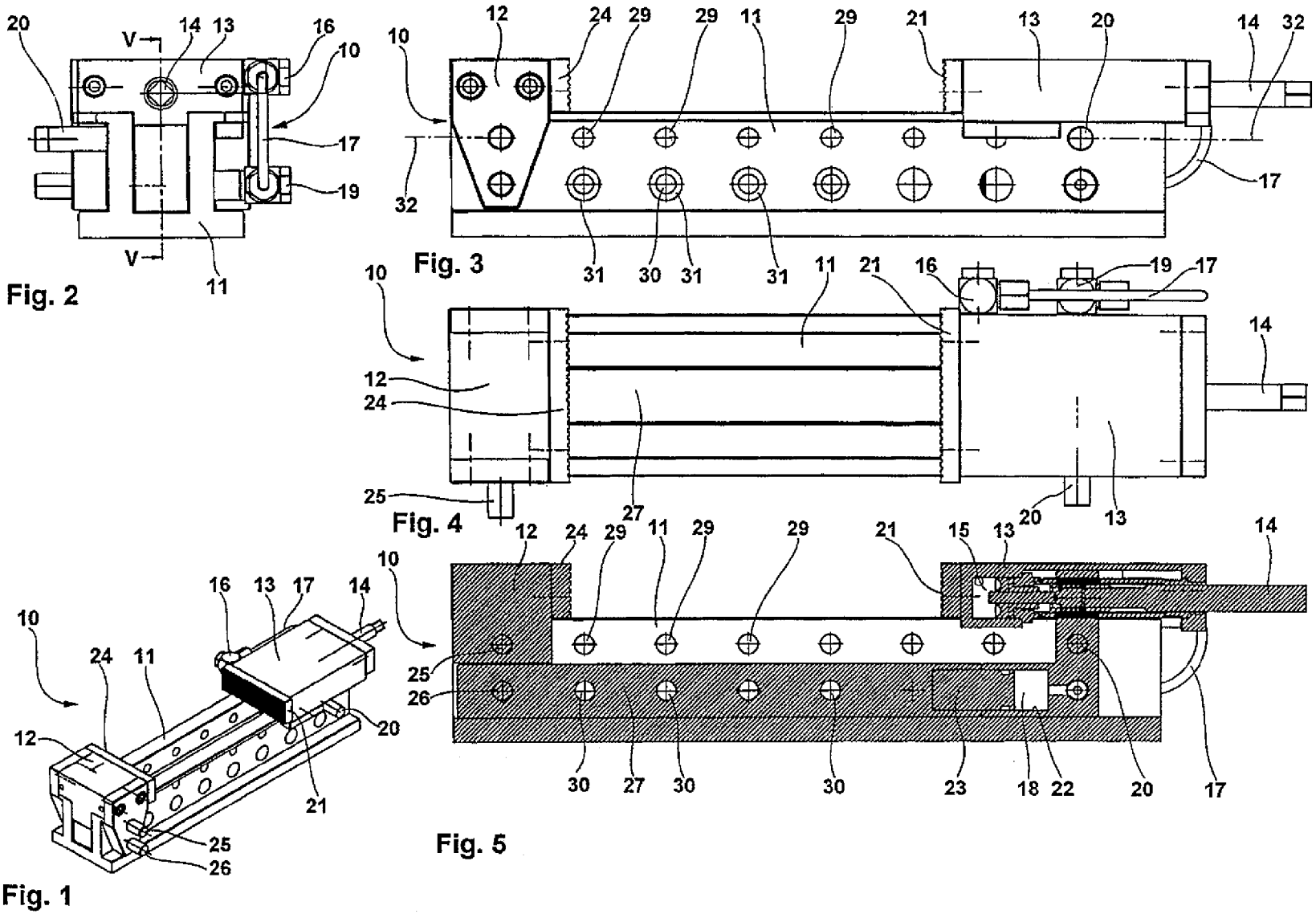

This invention relates to a clamping element for workpieces, in particular a vice, comprising a first clamping jaw and a second clamping jaw, which are mounted on a carriage bed.

Such clamping elements, namely vices, are known from practice as follows. In a mechanical, hydraulic or pneumatic way, the previous vices produce a clamping force, which via the item to be clamped, i.e. in general a workpiece, is absorbed by the clamping jaws acting as an abutment. In the process, a bending moment acts on a carriage bed guiding the clamping jaws, which bending moment must be compensated by the rigidity of said carriage bed. This leads to elastic deformations of the carriage bed, which impair the machining accuracies. For workpieces to be machined with high accuracy, it is therefore necessary to construct the carriage bed of the known vices more and more rigid and hence more and more heavy. It should also be considered that due to improved tools, higher machining speeds and as a result higher machining forces now act on the workpiece, which must be compensated by increasing the clamping force to be exerted by the vice. This increased clamping force in turn leads to a larger bending moment.

Proceeding therefrom, it is the object underlying the invention to create a clamping element, in particular a vice, in which a bending moment on the carriage bed has been avoided as a result of the construction.

For the solution of this problem, the clamping element of the invention is characterized in that the resultants of the forces introduced by the clamping jaws into the carriage bed as a result of the clamping forces acting on the clamping jaws are located in the plane of the neutral fibre of the carriage bed.

When clamping a workpiece, a circuit of forces from the workpiece via the clamping jaws and the carriage bed is obtained as a result of the clamping forces. In accordance with the invention, it has now been provided that the force introduced into the carriage bed is located in the plane of the neutral fibre of the carriage bed. As a result, only pure tensile or compressive forces will act in the carriage bed in longitudinal direction of the carriage bed. There no longer occurs a bending moment on the carriage bed.

In accordance with a constructive aspect of the invention, the inventive introduction of forces into the carriage bed can be achieved in that the first clamping jaw and/or the second clamping jaw are supported on a carriage bed by means of one pivot pin each, bores for the pivot pins being arranged in a neutral fibre of the carriage bed. The lever arm with which forces are introduced into the carriage bed as a result of the clamping forces thereby is reduced to zero, so that a bending moment is completely avoided. Depending on whether the clamping jaws constitute one-armed levers or two-armed levers, there are only obtained compressive or tensile forces acting on the carriage bed. Accordingly, the actuating member exerts tensile or compressive forces on the clamping jaws.

The clamping jaws preferably constitute two-armed levers, the one lever arm having associated thereto a clamping surface and the other lever arm acting on a push rod. Thus, the clamping device is duplicated, so to speak, onto a side of the neutral fibre opposite the workpiece, with the exception that instead of the workpiece the push rod is acted upon here. If the lever arms at the clamping jaws each are of equal length, equal forces will act on the push rod and the workpiece. In the known vices, a component of force vertical to the clamping force always acts on the carriage bed due to the type of mounting of the fixed clamping jaw. This has been avoided by means of the above-described embodiment. Independent of the basic idea of the invention, this already leads to a considerable reduction of the bending moment acting on the carriage bed, so that this embodiment can also be used advantageously independent of the basic idea.

In addition, the construction in accordance with the invention offers a further advantage. Due to the bending of the carriage bed and also due to the compressive forces acting on the clamping jaws, the clamping jaws of known clamping elements will "tilt" to the outside. In the known clamping elements, this has been compensated by relatively complicated measures, so-called low-tension elements or low-tension jaws. In the clamping element of the invention, these measures no longer are necessary, in particular when the pivot pins for the clamping jaws are arranged such that a downwardly directed component of movement is obtained at the clamping surfaces.

As an actuating member, there can preferably be used a pressure-fluid cylinder. A toggle mechanism, spindle drives or other mechanical, hydraulic, pneumatic or magnetic solutions are also conceivable.

The known vices are in part directly actuated by means of pressure fluid via an external hydraulic supply. In addition, there are also used vices in which a hydraulic piston is actuated by means of a spindle. A piston of larger diameter then is associated to the clamping jaw. The force exerted by the spindle thereby is amplified in proportion to the surfaces of the two pistons and provided as clamping force. Such vices are also referred to as vices with hydraulic power amplification.

In vices with hydraulic power amplification, but also in directly hydraulically driven vices, the available clamping force or the power transmission by the hydraulic pressure and the available space for the piston areas is limited.

To avoid the above-described disadvantage, the clamping element of the invention has a first pressure-fluid cylinder actuating one of the two clamping jaws, in addition to a further pressure-fluid cylinder actuating the respectively other clamping jaw, in accordance with an embodiment which, however, also is conceivable independently.

Accordingly, the second clamping jaw has a separate pressure-fluid supply and in turn produces a clamping force in addition to the clamping force of the first clamping jaw. The total clamping force hence is increased by the clamping force provided by the second clamping jaw.

Preferably, the further pressure-fluid cylinder is hydraulically or pneumatically coupled to the first pressure-fluid cylinder. Thus, only one pressure-fluid supply must be provided. In addition, the same pressure-fluid pressure is obtained in both pressure-fluid cylinders. In terms of construction, the simplest way is to connect the further pressure-fluid cylinder and the first pressure-fluid cylinder via a bypass conduit. This solution is recommendable in particular for vices with hydraulic power amplification, in which the spindle force is converted into the pressure-fluid pressure for the first and further pressure-fluid cylinders. When the piston areas of the first pressure-fluid cylinder and the further pressure-fluid cylinder are identical, identical clamping forces are obtained for both clamping jaws.

The further pressure-fluid cylinder preferably is arranged in a carriage bed of the clamping element. In practice, carriage beds are U-shaped sections, on top of which the clamping jaws are guided. In the carriage bed, enough space is available below the clamping jaws to accommodate the further pressure-fluid cylinder, so that the size of the clamping element on the whole is not changed.

Further features of the invention relate to constructive aspects of the clamping element.

Figure 6:
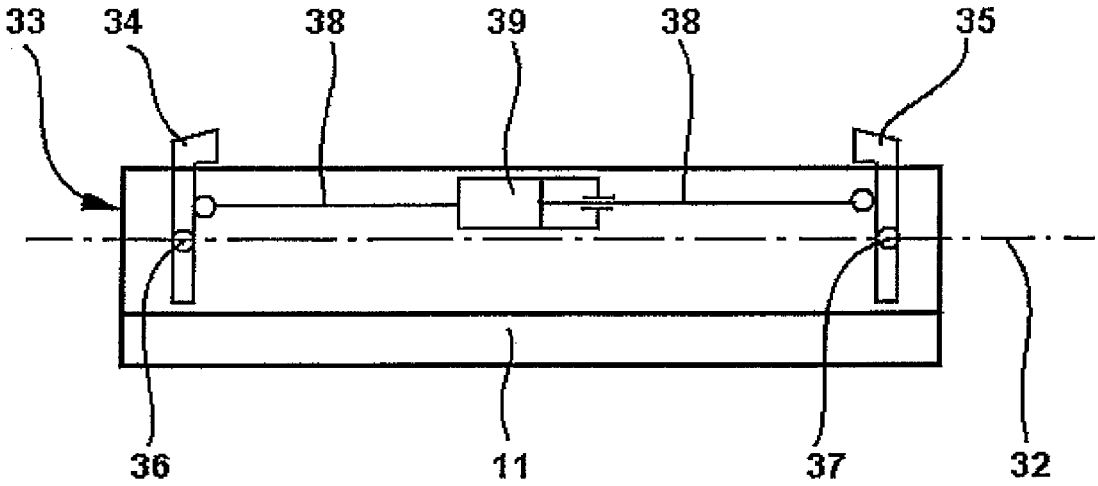
Figure 7:
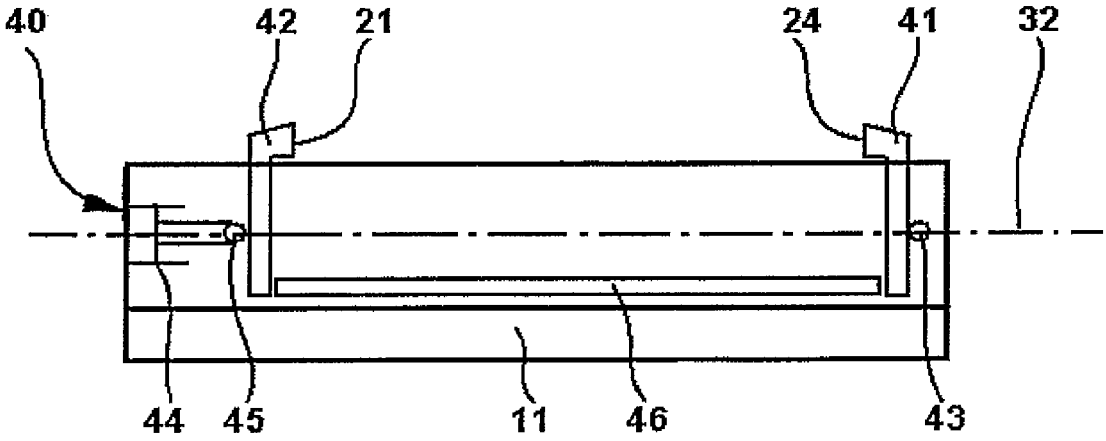

The invention will subsequently be explained with reference to an embodiment illustrated in the drawing, in which:

FIG. 1 shows a first embodiment of a clamping element, namely a vice, with the inventive features in a perspective representation, FIG. 2 shows the vice of FIG. 1 in a rear view, FIG. 3 shows the vice of FIG. 1 in a side view, FIG. 4 shows the vice of FIG. 1 in a top view, FIG. 6 shows a second embodiment of a clamping element, namely a vice, with the inventive features in a longitudinal section, and FIG. 7 shows a further embodiment of a clamping element, namely a vice, with the inventive features in a longitudinal section.

The clamping element shown in FIGS. 1 to 5 is a vice 10. This vice 10 includes a carriage bed 11 and a "fixed" clamping jaw 12 as well as a movable clamping jaw 13. The "fixed" clamping jaw 12 only is fixed in so far as it is not directly actuated over a larger distance when clamping a workpiece, which is illustrated more clearly in the subsequent description.

The clamping jaw 13 is a clamping jaw with hydraulic power amplification. The clamping jaw 13 is actuated via a spindle 14. By means of the spindle 14, the clamping jaw 13 is moved towards the workpiece, until it comes to abut against the workpiece. Then, the spindle 14 only exerts pressure onto a hydraulic fluid in a hydraulic cylinder 15, which in turn acts on a further piston area inside the clamping jaw 13 in a manner known per se. The clamping jaw 13 has a possibility for connection to an external hydraulic conduit. This has already been the case in the prior art, in order to be able to possibly also connect the existing clamping jaw 13 to an external hydraulic conduit. To this hydraulic connection a bypass conduit 17 is connected via a hydraulic screw connection 16. Below the clamping jaw 13, a further pressure-fluid cylinder 18 is provided, which is supplied with pressure fluid via the bypass conduit 17 which is connected to the further pressure-fluid cylinder 18 via a further hydraulic screw connection 19.

The clamping jaw 13 constitutes a two-armed lever and is retained at the carriage bed 11 via a pivot pin 20. The upper lever arm of the clamping jaw 13 is connected with the pressure-fluid cylinder 15 and the spindle 14 as well as a pressing plate 21 for clamping the workpiece. At the lower lever arm of the clamping jaw 13 a cylinder bore 22 of the further pressure-fluid cylinder 18 is provided, in which a piston 23 is guided.

The second clamping jaw 12 likewise constitutes a two-armed lever, the upper lever arm carrying a pressing plate 24 for clamping the workpiece. The clamping jaw 12 in turn is pivotally connected with the carriage bed 11 via a pivot pin 25. Via a pivot pin 26, a push rod 27 is mounted to the lower lever arm, which in turn can be actuated by the piston 23 of the further pressure-fluid cylinder 18.

To be able to adjust the clamping capacity of the vice 10, bores 29 are provided in the carriage bed 11 in a manner known per se. Correspondingly, bores 30 are likewise provided in the push rod 27, so that by changing the pivot pins 25 and 26 the clamping jaw 12 can be displaced and thus the clamping capacity of the vice can be adjusted. Furthermore, a number of bores 31 corresponding to the number of bores 30 in the push rod 27 is provided in the carriage bed 11, whose diameter is dimensioned larger than the diameter of the pivot pin 26 by a sufficient amount, so that said pivot pin can freely move in the respective bore 31 when the push rod 27 is actuated. Alternatively, an oblong hole can also be provided in the carriage bed 11 in this area.

The pivot pins 25 and 26 are arranged further to the outside than the clamping surfaces 21 and 24. When clamping the workpiece, components of movement directed towards the carriage bed 11 therefore are obtained on the clamping surfaces 21 and 24, which exert a low-tension effect on the workpiece to be clamped.

The vice 10 described so far now operates as follows. The pressing plate 21 first is moved to abut against the workpiece by actuating the spindle 14. Then, the first hydraulic piston 15 becomes active and effects the amplification of the clamping force. At the same time, the hydraulic pressure produced in the first pressure-fluid cylinder 15 is conducted via the bypass conduit 17 to the further pressure-fluid cylinder 18, so that the push rod 27 actuates the second clamping jaw 12 via the pivot pin 26. The pressing plate 24 likewise tilts against the workpiece and in turn subjects the workpiece to a compressive force or tensile force determined by the pressure in the pressure-fluid cylinder 18 as well as the piston area of the piston 23 and the relation of the lever arms at the clamping jaw 12.

Another particularity of the vice illustrated here is the fact that the bores 29 are arranged in the neutral fibre 32 (based on the areal moment of inertia) of the carriage bed 11. No bending forces are introduced thereby into the carriage bed 11. Rather, the carriage bed 11 merely is subjected to a tensile load. The clamping surfaces 21, 24 on the one hand and the push rod 27 on the other hand are arranged on opposite sides of the neutral fibre 32.

As an alternative to the mechanical actuation via the spindle 14, the clamping force can, however, also be applied via an external hydraulic supply. For this purpose, an additional connection for the external hydraulic supply is for instance provided at a suitable point on the bypass conduit 17.

FIG. 6 shows an embodiment of a vice 33, in which the clamping jaws 34 and 35 constitute one-armed levers and are mounted to the carriage bed 11 via joints 36, 37. The joints 36, 37 are again arranged in the neutral fibre 32. The clamping jaws 34, 35 are actuated via tie rods 38 extending parallel to the neutral fibre 32, which are drawn together by means of a pressure-fluid cylinder 39.

The vice 40 shown in FIG. 7 comprises two clamping jaws 41, 42. The one clamping jaw 41 is pivotally mounted on the carriage bed 11, the joint 43 again lying in the neutral fibre 32 of the carriage bed 11. The other clamping jaw 42 is mounted on the carriage bed 11 via a pressure-fluid cylinder 44, whose actuating means is arranged in the neutral fibre 32 and which engages the clamping jaw 42 by means of a joint 45 which again is located in the neutral fibre 32. The clamping jaws 41, 42 constitute two-armed levers, the clamping surfaces 21, 24 each being associated to the one lever arm. At the other lever arm, the clamping jaws 41, 42 are coupled to each other via a push rod 46 extending parallel to the neutral fibre 32. As in the embodiment shown in FIGS. 1 to 5, the push rod 46 is located on the side of the neutral fibre 32 opposite the clamping surfaces 21, 24.

In the embodiments as shown in FIGS. 6 and 7, it is of course also possible to allocate separate pressure-fluid cylinders to each of the two clamping jaws 34, 35 and 41, 42, respectively.

LIST OF REFERENCE NUMERALS

10 vice
11 carriage bed
12 clamping jaw
13 clamping jaw

14 spindle
15 pressure-fluid cylinder
16 hydraulic screw connection
17 bypass conduit
18 pressure-fluid cylinder
19 hydraulic screw connection
20 pivot pin
21 pressing plate
22 cylinder bore
23 piston
24 pressing plate
25 pivot pin
26 pivot pin
27 push rod
28
29 bore
30 bore
31 bore
32 neutral fibre
33 vice
34 clamping jaw
35 clamping jaw
36 joint
37 joint
38 tie rod
39 pressure-fluid cylinder
40 vice
41 clamping jaw
42 clamping jaw
43 joint
44 pressure-fluid cylinder
45 joint

The invention claimed is:

1. A clamping element for a vice, comprising a first clamping jaw and a second clamping jaw, which are mounted on a carriage bed, wherein the first clamping jaw, the second clamping jaw, or a combination thereof is supported on a carriage bed by one pivot pin each, wherein a plurality of bores is provided in the carriage bed so that by changing the pivot pins from one bore to the other the first clamping jaw, the second clamping jaw, or both the first and second clamping jaw can be displaced along the carriage bed, in which the bores for the pivot pins are arranged in a neutral axis of the carriage bed, wherein the resultants of the forces introduced by the clamping jaws into the carriage bed as a result of the clamping forces acting on the clamping jaws are located in the plane of the neutral axis of the carriage bed.

2. The clamping element as claimed in claim 1, characterized in that the clamping jaws constitute two-armed levers, a clamping surface being associated to the one lever arm and a push rod engaging the other lever arm.

3. The clamping element as claimed in claim 2, characterized in that the lever arms are of equal length.

4. The clamping element as claimed in claim 1, characterized in that an actuating member is supported on one of the clamping jaws, preferably on the first clamping jaw, and the other clamping jaw is actuated by means of a push rod.

5. The clamping element as claimed in claim 4, characterized in that the actuating member is a pressure-fluid cylinder.

6. The clamping element as claimed in claim 1, characterized in that the first clamping jaw is actuated by means of a first pressure-fluid cylinder and the second clamping jaw has associated thereto a further pressure-fluid cylinder.

7. The clamping element as claimed in claim 6, characterized in that the further pressure-fluid cylinder is hydraulically or pneumatically coupled to the first pressure-fluid cylinder.

8. The clamping element as claimed in claim 6, characterized in that the first and further pressure fluid cylinders are connected with each other by means of a bypass conduit.

9. The clamping element as claimed in claim 6, characterized in that the first pressure-fluid cylinder and the further pressure-fluid cylinder have identical piston diameters.

10. The clamping element as claimed in claim 6, characterized in that the further pressure-fluid cylinder is arranged in the carriage bed.

* * * * *